US010087692B2

(12) United States Patent
Al Dabbous et al.

(10) Patent No.: US 10,087,692 B2
(45) Date of Patent: Oct. 2, 2018

(54) LASER PROPELLED TRACTOR WITH LASER OPERATED LOGGING TOOLS

(71) Applicant: Saudi Arabian Oil Company, Dhahran (SA)

(72) Inventors: Mohammed Saeed Al Dabbous, Qatif (SA); David Rucker Lewis, RTSC (SA)

(73) Assignee: Saudi Arabian Oil Company, Dhahran (SA)

( * ) Notice: Subject to any disclaimer, the term of this patent is extended or adjusted under 35 U.S.C. 154(b) by 528 days.

(21) Appl. No.: 14/802,130

(22) Filed: Jul. 17, 2015

(65) Prior Publication Data

US 2017/0016291 A1 Jan. 19, 2017

(51) Int. Cl.

| | |
|---|---|
| ***E21B 23/14*** | (2006.01) |
| ***E21B 23/00*** | (2006.01) |
| ***E21B 49/08*** | (2006.01) |

(52) U.S. Cl.

CPC ..... *E21B 23/00* (2013.01); *E21B 23/14* (2013.01); *E21B 49/08* (2013.01); *E21B 2023/008* (2013.01)

(58) Field of Classification Search

CPC ..... E21B 23/14; E21B 2023/008

See application file for complete search history.

(56) References Cited

U.S. PATENT DOCUMENTS

| | | | |
|---|---|---|---|
| 5,837,964 | A | 11/1998 | Emer et al. |
| 6,888,097 | B2 | 5/2005 | Batarseh |
| 7,719,676 | B2 | 5/2010 | DiFoggio |
| 2004/0188142 | A1* | 9/2004 | Self ..... E21B 7/046 175/53 |
| 2010/0326659 | A1 | 12/2010 | Schultz et al. |
| 2012/0074110 | A1 | 3/2012 | Zediker et al. |
| 2013/0061571 | A1 | 3/2013 | Burdine |

FOREIGN PATENT DOCUMENTS

| | | | |
|---|---|---|---|
| CA | 2819977 | A1 | 1/2015 |
| CN | 101737201 | A | 6/2010 |
| WO | 2008035859 | A1 | 3/2008 |

OTHER PUBLICATIONS

International Search Report and Written Opinion for related PCT application PCT/US2016/042509 dated Oct. 24, 2016.

Wallace, John, "Hybrid laser-ablation/gas-nozzle propulsion could propel rockets to orbit", LaserFocusWorld, Oct. 29, 2014.

* cited by examiner

*Primary Examiner* — Robert E Fuller

(74) *Attorney, Agent, or Firm* — Bracewell LLP; Constance G. Rhebergen; Linda L. Morgan

(57) ABSTRACT

A method for maneuvering and operating a tool within a wellbore of a subterranean well includes providing a tractor assembly having a fluid chamber with a port extending through a sidewall of the fluid chamber. The port is moved to the open position to allow a well fluid of the subterranean well to flow into the fluid chamber. The port is moved to the closed position to prevent the well fluid from flowing between the interior of the fluid chamber and the exterior of the fluid chamber. A heating laser beam is generated with a laser and directed towards the fluid chamber to increase the temperature of the well fluid within the fluid chamber. The port is moved to the open position to allow the high heat well fluid to flow out of the fluid chamber to accelerate the tractor assembly within the wellbore.

20 Claims, 2 Drawing Sheets

LASER PROPELLED TRACTOR WITH LASER OPERATED LOGGING TOOLS

BACKGROUND OF THE INVENTION

1. Field of the Invention

The present invention relates to operations in a wellbore associated with the production of hydrocarbons. More specifically, the invention relates to a tool for use in wellbores.

2. Description of the Related Art

Downhole tools are used in the hydrocarbon industry for well intervention, reservoir characterization, and pipe recovery. Downhole tools can provide well information and perform well services such as depth correlation, wellbore flow characterization, cement integrity evaluations, wellbore diagnostic operations, and remedial operations. Logs constantly retrieve measurements downhole via communication lines such as electrical wireline. Logs can measure resistivity, conductivity, porosity, wave transmit time and so forth. These critical parameters are of paramount importance for geologists, drilling, reservoir, and production engineers from which vital decisions are made during various phases of exploration and development. Furthermore, logs are used frequently in workover operations where wells need remedial work in order to flow efficiently.

Often in the recovery of hydrocarbons from subterranean formations, wellbores are drilled with highly deviated or horizontal portions that can extend through one or a number of separate hydrocarbon-bearing production zones. Tractors are used to force tool string, such as coiled tubing, wireline and slickline, into the hole in highly deviated and horizontal wells where gravity does not play any crucial role.

Coiled tubing can retain some amount of residual curvature as the coiled tubing is rolled off of the coiled tubing reel and fed down the wellbore. The residual curvature as well as the bends and deviations of the wellbore can cause the coiled tubing to engage the sidewall of the wellbore and generate frictional resistance. If the frictional resistance reaches a certain level, the coiled tubing can no longer be pushed into the wellbore. This phenomenon is known as coiled tubing lockup or helical lock up. Coiled tubing lock up is major issue related to access of the wellbore. At times, up to 75% of some wellbores have no direct coiled tubing access and given the magnitude of frictional resistance that must be overcome, conventional well tractors can't always get the coiled tubing and associated tools to the desired location within the wellbore or to the well total depth.

Conventional tractors can use wheels to push against the side of the wellbore, which increases the force required to push the wireline tools. The use of tractors with wheels increases the gross size of the tool, which is a significant parameter in determining the appropriate type of tractors that could be used for diverse sized holes.

SUMMARY OF THE INVENTION

The systems and methods of this disclosure provide a tool to push tool string, such as coiled tubing, wireline and slickline, into the wellbore in highly deviated and horizontal wells where gravity does not play any crucial role, without the use of tractor tires and with the ability to apply sufficient force to overcome coiled tubing lock up. Embodiments of this disclosure use lasers to act as a form of propulsion. The lasers can further be used to perform logging functions.

In embodiments of the current disclosure, a method for maneuvering and operating a tool within a wellbore of a subterranean well includes providing a tractor assembly having a fluid chamber with a port extending through a sidewall of the fluid chamber. The port is moveable between an open position and a closed position. The port is moved to the open position to allow a well fluid of the subterranean well to flow into the fluid chamber. The port is moved to the closed position to prevent the well fluid from flowing between the interior of the fluid chamber and the exterior of the fluid chamber. A heating laser beam is generated with a laser mounted adjacent to the fluid chamber and directed towards the fluid chamber to increase the temperature of the well fluid within the fluid chamber to generate a high heat well fluid. The port is moved to the open position to allow the high heat well fluid to flow out of the fluid chamber to accelerate the tractor assembly within the wellbore.

In alternate embodiments, the fluid chamber can be formed of silicon carbide. The steps of moving the port to the open position and moving the port to the closed position can include signaling the port with an opening control system located at a surface location. Properties of the well fluid within the fluid chamber can be sensed with a sensor located at the fluid chamber, the sensor communicating with an opening control system located at a surface location. The steps can be repeated to continue moving the tractor assembly within the wellbore.

In other alternate embodiments, the high heat well fluid can be in a plasma state. The tractor assembly can be centralized in the wellbore with centralizers extending from the fluid chamber. A logging laser beam can be generated and a resulting laser beam can be received with a receiver. Properties of the resulting laser beam can be measured to determine characteristics of a reservoir. The logging laser beam can be filtered to form a filtered laser beam with a wavelength between 800 and 1000 nanometers In an alternate embodiment of this disclosure, a method for maneuvering and operating a tool within a wellbore of a subterranean well includes providing a tractor assembly having a fluid chamber with a port extending through a sidewall of the fluid chamber. The port is moveable between an open position and a closed position. The tractor assembly and a tool can be attached to a tool string and the tool string can be lowered into the wellbore of the subterranean well. The port can be moved to the open position to allow a well fluid in the wellbore of the subterranean well to flow into the fluid chamber. The port can be moved to the closed position to prevent the well fluid from flowing between the interior of the fluid chamber and the wellbore. A heating laser beam can be generated with a laser mounted adjacent to the fluid chamber and directed towards the fluid chamber to increase the temperature of the well fluid within the fluid chamber to generate a high heat well fluid. The port can be moved to the open position to allow the high heat well fluid to flow out of the fluid chamber. The high heat well fluid can be directed into the wellbore with a nozzle to accelerate the tractor assembly within the wellbore so that the tractor assembly reaches an operating location within the wellbore. The tool can be operated within the wellbore.

In alternate embodiments, the method can include repeating the steps to move the tractor assembly to a second operating location within the wellbore. A logging laser beam can be generated and a resulting laser beam can be received with a receiver. Properties of the resulting laser beam can be measured to determine characteristics of a reservoir. The logging laser beam can be filtered to form a filtered laser beam with a wavelength between 800 and 1000 nanometers.

In another alternate embodiment of this disclosure, a tractor assembly for maneuvering and operating a tool within a wellbore of a subterranean well includes a fluid chamber. A laser source is mounted adjacent to the fluid chamber and selectively directed towards the fluid chamber. A port extends through a sidewall of the fluid chamber, the port moveable between an open position and a closed position, wherein in the open position, a well fluid can flow between an interior of the fluid chamber and an exterior of the fluid chamber, and in the closed position, the well fluid is blocked from flowing between the interior of the fluid chamber and the exterior of the fluid chamber. A nozzle is in fluid communication with the port, the nozzle selectively directing fluid from within the fluid chamber out of the fluid chamber in a direction for accelerating the tractor assembly within the wellbore.

In alternate embodiments, centralizers can extend from the fluid chamber, the centralizers sized to centralize the tractor assembly within the wellbore. An opening control system can be located at a surface location. The opening control system can be in communication with the ports and selectively signaling the ports to move between the open position and the closed position. A sensor can be located at the fluid chamber and can sense properties of the well fluid within the fluid chamber. The sensor can be in communication with the opening control system located at a surface location.

In other alternate embodiments, a receiver can selectively receive a resulting laser beam that results from a logging laser beam. A filter can filter the logging laser beam to form a filtered laser beam with a wavelength between 800 and 1000 nanometers. The fluid chamber can be formed of silicon carbide.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternate embodiments or positions.

In the following discussion, numerous specific details are set forth to provide a thorough understanding of the present invention. However, it will be obvious to those skilled in the art that the present invention can be practiced without such specific details. Additionally, for the most part, details concerning well drilling, reservoir testing, well completion and the like have been omitted inasmuch as such details are not considered necessary to obtain a complete understanding of the present invention, and are considered to be within the skills of persons skilled in the relevant art.

Figure 1:
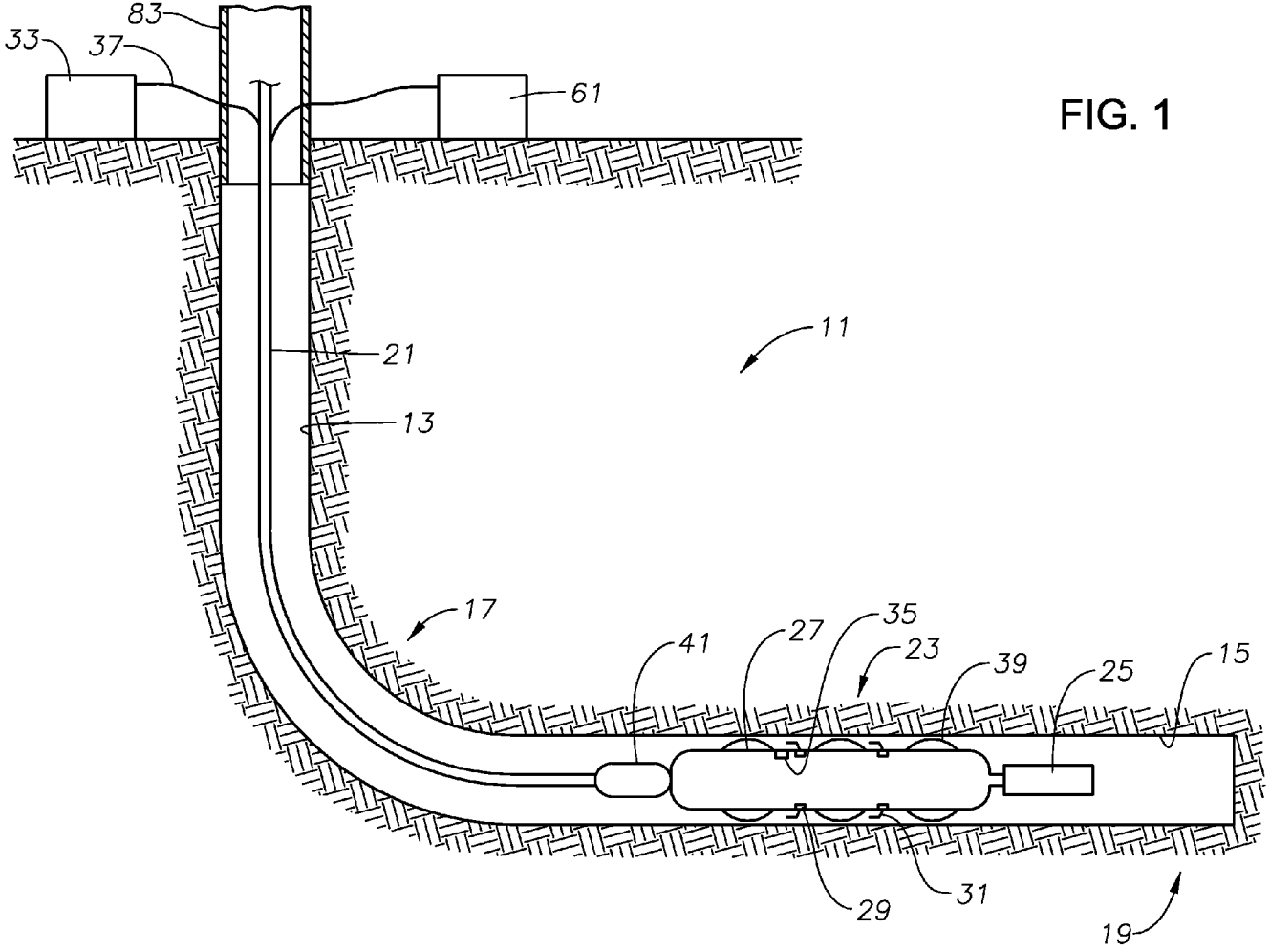
FIG. 1 is a schematic representation of a portion of a subterranean well with a tractor assembly in accordance with an embodiment of the present disclosure

Referring to FIG. 1, a well system 11 includes a subterranean well with a wellbore 13. In the illustrated embodiment, wellbore 13 includes a lateral bore 15 having a heel 17 and a toe 19. A tool string 21 extends into the wellbore 13. Tool string 21 can be, for example coiled tubing, wireline or slickline. Tool string 21 has a tractor assembly 23 connected to its lower end. Tractor assembly 23 is used to maneuver tool string 21 within wellbore 13 of the subterranean well. Downhole tool 25 can be associated with the tractor assembly 23. In the illustrated embodiment of FIG. 1, tool 25 is attached to a side of tractor assembly 23 opposite tool string 21. In alternate embodiments, tool 25 can be attached between tractor assembly 23 and tool string 21 or can be located along tool string 21 a distance apart from tractor assembly 23. In addition to tool 25, tractor assembly 23 can also have a casing collar locator to help identify the location of tractor assembly 23 within wellbore 13.

Figure 2:
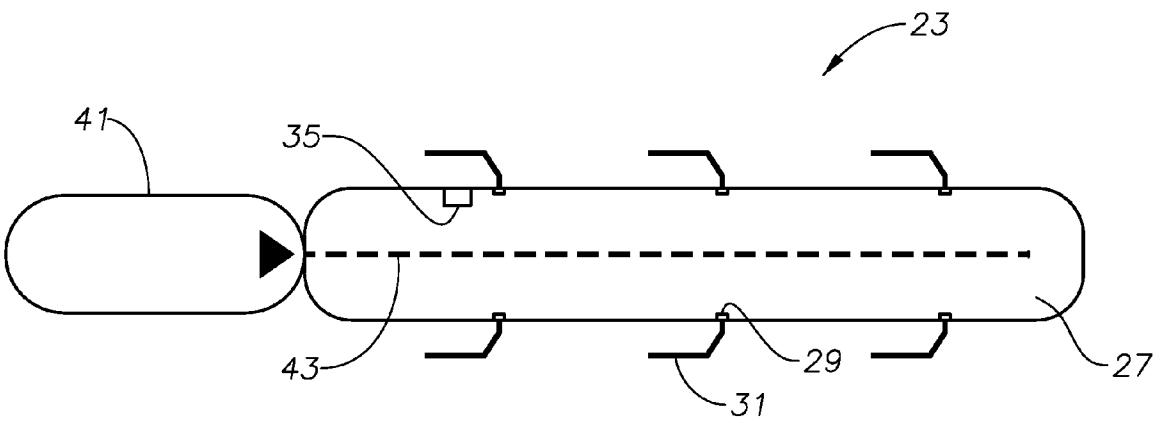
FIG. 2 is a section view of the tractor assembly of FIG. 1.

Looking at FIGS. 1-2, tractor assembly 23 has fluid chamber 27. Fluid chamber 27 can be a generally tubular member with curved end surfaces that has an internal cavity. Port 29 extends through a sidewall of fluid chamber 27. Fluid chamber 27 can be formed of a material with high thermal conductivity, such as silicon carbide, which has a thermal conductivity of 3.6-4.9 W/(cm*k). Silicon Carbide is particularly well suited for such an application as it does not melt at any known pressure. In the example of FIG. 1, four ports 29 are shown and in the example of FIG. 2, six ports 29 are shown. In alternate embodiments, fluid chamber 27 can have less than four or more than six ports 29. Port 29 is moveable between an open position and a closed position. In the open position, port 29 provides a fluid flow path between the interior of fluid chamber 27 and the exterior of fluid chamber 27 so that well fluid of the subterranean well can flow into fluid chamber 27. The well fluid can be whatever fluids are present in wellbore 13 in the vicinity of tractor assembly 23 when port 29 is opened. In the closed position, port 29 prevents well fluid from flowing between the interior of fluid chamber 27 and the exterior of fluid chamber 27 by block blocking the fluid flow path between the interior of fluid chamber 27 and the exterior of fluid chamber 27.

In certain embodiments, tractor assembly 23 can also have nozzle 31. Nozzle 31 extends from port 29 and can direct well fluid that is within fluid chamber 27 into wellbore 13. Fluid from the interior of fluid chamber 27 can exit port 29 when port 29 is in the open position and then pass through nozzle 31 and into the wellbore 13. As will be described in further detail below, well fluid flowing out through nozzle 31 can be directed to accelerate tractor assembly 23 within wellbore 13 in a direction generally opposite the direction that the nozzle 31 is pointing. In the example embodiments of FIGS. 1-2, there is shown a nozzle 31 at each port 29 and each nozzle 31 pointing in the same general direction, which is in a direction out of wellbore 13. In alternate embodiments, there may be no nozzle 31 or there may be a nozzle 31 at some of the ports 29. In such embodiments, port 29 may be formed in the sidewall of fluid chamber 27 to point in a desired direction. In other alternate embodiments, some nozzles 31 can point in different directions than other nozzles 31. For example, some nozzles 31 may point into wellbore 13 for assisting in moving tractor assembly 23 out of wellbore 13.

In order to signal port 29 to move between the open position and the closed position, opening control system 33 can be located at a surface location outside of wellbore 13. Sensor 35 can communicate with opening control system 33. Sensor 35 can be located at fluid chamber 27 and can sense properties of the well fluid within fluid chamber 27. Tractor assembly 23 can have a single sensor 35, as shown in the example configurations of FIGS. 1-2. In such an embodiment, single sensor 35 can signal all of the port 29 to move between the open position and the closed position. In alternate embodiments, there can be one sensor 35 for each port 29. Sensor 35 can signal ports 29 collectively or individually so that each port 29 can be moved between the open and closed position on an individual basis. Sensor 35 can be in communication with opening control system 33 by way of cable 37 that extends into wellbore 13 from opening control system 33. In alternate embodiments, sensor 35 can be in communication with opening control system 33 by means of wireless telemetry or other means known in the art.

Looking at FIG. 1, tractor assembly 23 also has centralizers 39 extending from fluid chamber 27. Centralizers 39 assist to centralize tractor assembly 23 within wellbore 13. In alternate embodiments, wheels could be used for centralization in cased holes instead of centralizers 39; however, centralizers 39 are utilized in a preferred embodiment to stabilize the tractor assembly 23 and by skidding along the wellbore surface area, thus reducing the issues related to wheel contact with wellbore 13 due to irregularities within the wellbore.

Tractor assembly 23 further includes laser source 41. Laser source 41 is mounted adjacent to fluid chamber 27 and can be attached to tool string 21 with a cable head. Laser source 41 is directed towards fluid chamber 27. A conical shaped body can direct a heating laser beam 43 generated and emitted by laser source 41 towards fluid chamber 27. Heating laser beam 43 can heat the wellbore fluids within fluid chamber 27 until such fluids change phase and become, for example, a steam, a gas-phase material, plasma, or other phase capable of producing thrust, and become a high heat well fluid. Laser source 41 can be a CO2, Nd:YAG, COIL, MIRACL, fiber laser, or other known type of laser.

Figure 3:
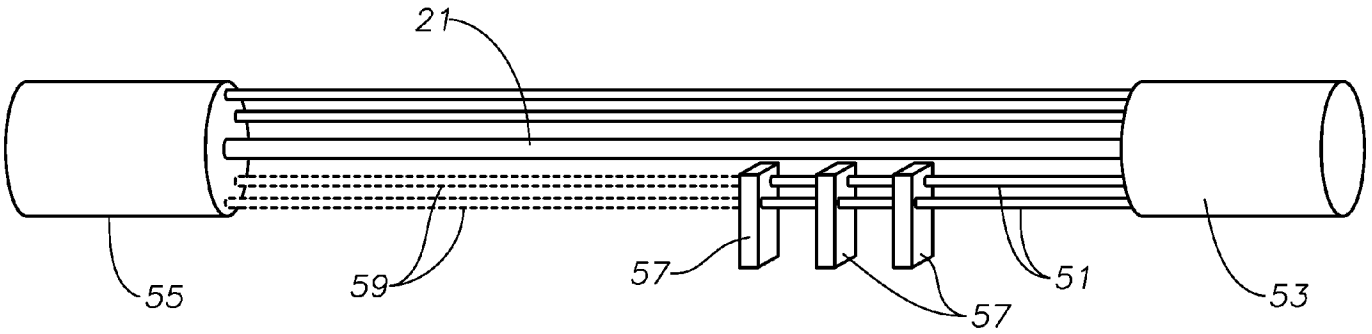
FIG. 3 is a schematic view of a laser logging assembly of a tractor assembly in accordance with an embodiment of the present disclosure.

Looking at FIG. 3, in certain embodiments a laser can also be used for logging operations. A logging laser beam 51 can be generated by logging laser source 53. Logging laser beam 51 can be directed parallel to the hydrocarbon formation adjacent wellbore 13. Logging laser beam 51 can pass through wellbore fluids and a resulting laser beam will be received by receiver 55. Receiver 55 can be attached to tool string 21 at a distance from logging laser source 53. As an example, receiver 55 can be located one to five feet from logging laser source 53, and in one embodiment, can be located three feet from logging laser source 53. Logging laser beam 51 can be filtered by filters 57 to block out all wave lengths of logging laser beam 51 except for a small portion of the spectrum which has a desired wave length and form filtered laser beam 59. As an example, filters 57 can block out all wave lengths of logging laser beam 51 except for wave lengths between 800 and 1000 nanometers. This will convert the visible laser beams of logging laser beam 51 to invisible infrared laser beams. The infrared laser beams can be used to measure, for example, the water-cut of the wellbore fluid by exploiting water attenuation of these beams.

Properties of the resulting laser beam can be measured to determine characteristics of a reservoir. As an example, as fluids exit the formation, the velocity of logging laser beam 51 will change as logging laser beam 51 passes from one medium to another. By calculating the transit time for logging laser beam to reach receiver 55. Transit time is one of the most important parameters in formation evaluation. In addition, the phase, and hence the type of wellbore fluid can be determined. In this way, as an example, the water cut of the wellbore fluid can also be calculated. In order to confirm properties of the wellbore fluid, fiber optics system 61 (FIG. 1) can be used to measure the temperature of the wellbore fluid and conventional spinner flow meters can alternately be utilized.

Both the fiber optics line and tool string 21 can be protected with steel in the vicinity of logging laser beam 51. More than one combination of logging laser source 53 and receiver 55 can be located along tool string 21. As an example, if a spinner flow meter is used, a first combination of logging laser source 53 and receiver 55 can be located on one side of the spinner flow meter and a second combination of logging laser source 53 and receiver 55 can be located on the other side of the spinner flow meter.

In an example of operation, tractor assembly 23 and tool 25 can be attached to tool string 21. In certain embodiments, logging laser source 53 and receiver 55 can also be located along tool string 21. Tool string 21 can be lowered into wellbore 13. If tool string 21 can no longer progress along wellbore 13 and the operating location of tool 25 has not yet been reached, tractor assembly 23 can be operated to continue to maneuver tool string 21 along wellbore 13. This could happen, for example, in a coiled tubing lock up situation. In embodiments where logging is to take place the operating location may be, as an example, at the bottom end of wellbore 13 so that logging can take place from the bottom end of wellbore 13.

Port 29 can then be moved to the open position so that wellbore fluid can flow into fluid chamber 27. Port 29 can be signaled to move to the open position by sensor 35, which in turn is signaled from opening control system 33. The level of fluid in fluid chamber 27 can be monitored by sensor 35 and once the fluid chamber 27 is full, sensor 35 can signal port 29 to move to the closed position to prevent the well fluid from flowing between the interior of fluid chamber 27 and wellbore 13.

Heating laser beam 43 can then be generated by laser source 41 and directed towards fluid chamber 27 to increase the temperature of the well fluid within fluid chamber 27 to generate a high heat well fluid. Sensor 35 can monitor the temperature of the wellbore fluid within fluid chamber 27. Once high heat well fluid has reached a sufficient phase, port 29 can be moved to an open position by a signal from sensor 35, allowing high heat well fluid to exit fluid chamber 27. The high heat fluid will exit fluid chamber 27 with a sufficient force to accelerate tractor assembly 23 within wellbore 13. Nozzle 31 can direct the high heat well fluid into the wellbore in the desired direction, generally opposing the direction of desired travel of tractor assembly 23. Tractor assembly 23 can reach a sufficiently high controlled velocity to overcome a coiled tubing lockup, a velocity which some conventional tractors cannot achieve. Tool string 21 can act as a tether to tractor assembly 23 and can provide breaking forces as required. If tractor assembly 23 does not reach the operating location within the wellbore, the process can be repeated until tractor assembly 23 does reach the operating location. Tool 25 can then be operated and logging operations can begin, as applicable.

In order to perform logging operations, in certain embodiments, logging laser beam 51 can be generated by logging laser source 53 and directed though wellbore fluid. The resulting laser beam can be received by receiver 55. By measuring the properties of the resulting laser beam, characteristics of the reservoir can be determined. If logging operations are to be repeated in a number of passes, tractor assembly 23 can once again be operated to move tractor assembly back to the operating location.

As discussed herein, embodiments of the current disclosure therefore do not require wheels to maneuver tool string 21 within wellbore 13. This allows tractor assembly 23 to be utilized in smaller wellbores, in wellbores with steeper or more corners or doglegs, and in wellbores with more other irregular shapes and restrictions, compared to tractor assemblies that utilize wheels. Without wheels, tractor assembly 23 does not rely on traction and friction to accelerate and decelerate, making these operations more efficient and energy saving.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method for maneuvering and operating a tool within a wellbore of a subterranean well, the method comprising:

(a) providing a tractor assembly having a fluid chamber with a port extending through a sidewall of the fluid chamber, the port moveable between an open position and a closed position;

(b) moving the port to the open position to allow a well fluid of the subterranean well to flow into the fluid chamber;

(c) moving the port to the closed position to prevent the well fluid from flowing between an interior of the fluid chamber and an exterior of the fluid chamber;

(d) generating a heating laser beam with a laser mounted adjacent to the fluid chamber and directing the heating laser beam towards the fluid chamber to increase a temperature of the well fluid within the fluid chamber to generate a high heat well fluid; and (e) moving the port to the open position to allow the high heat well fluid to flow out of the fluid chamber to accelerate the tractor assembly within the wellbore.

2. The method according to claim 1, wherein the steps of moving the port to the open position and moving the port to the closed position include signaling the port with an opening control system located at a surface location.

3. The method according to claim 1, further comprising sensing properties of the well fluid within the fluid chamber with a sensor located at the fluid chamber, the sensor communicating with an opening control system located at a surface location.

4. The method according to claim 1, further comprising repeating steps (b)-(f) to continue moving the tractor assembly within the wellbore.

5. The method according to claim 1, wherein the high heat well fluid is in a plasma state.

6. The method according to claim 1, further comprising centralizing the tractor assembly in the wellbore with centralizers extending from the fluid chamber.

7. The method according to claim 1, further comprising generating a logging laser beam, receiving a resulting laser beam with a receiver, and measuring properties of the resulting laser beam to determine characteristics of a reservoir.

8. The method according to claim 7, further comprising filtering the logging laser beam to form the resulting laser beam with a wavelength between 800 and 1000 nanometers.

9. The method according to claim 1, wherein the fluid chamber is formed of silicon carbide.

10. A method for maneuvering and operating a tool within a wellbore of a subterranean well, the method comprising:

(a) providing a tractor assembly having a fluid chamber with a port extending through a sidewall of the fluid chamber, the port moveable between an open position and a closed position;

(b) attaching the tractor assembly and the tool to a tool string and lowering the tool string into the wellbore of the subterranean well;

(c) moving the port to the open position to allow a well fluid in the wellbore of the subterranean well to flow into the fluid chamber;

(d) moving the port to the closed position to prevent the well fluid from flowing between an interior of the fluid chamber and the wellbore;

(e) generating a heating laser beam with a laser mounted adjacent to the fluid chamber directed towards the fluid chamber to increase a temperature of the well fluid within the fluid chamber to generate a high heat well fluid;

(f) moving the port to the open position to allow the high heat well fluid to flow out of the fluid chamber;

(g) directing the high heat well fluid into the wellbore with a nozzle to accelerate the tractor assembly within the wellbore so that the tractor assembly reaches an operating location within the wellbore; and (h) operating the tool within the wellbore.

11. The method according to claim 10, further comprising repeating steps (c)-(g) to move the tractor assembly to a second operating location within the wellbore.

12. The method according to claim 10, further comprising generating a logging laser beam, receiving a resulting laser beam with a receiver, and measuring properties of the resulting laser beam to determine characteristics of a reservoir.

13. The method according to claim 12, further comprising filtering the logging laser beam to form the resulting laser beam with a wavelength between 800 and 1000 nanometers.

14. A tractor assembly for maneuvering and operating a tool within a wellbore of a subterranean well, the assembly comprising:

a fluid chamber with a port extending through a sidewall of the fluid chamber, the port moveable between an open position and a closed position, wherein in the open position, a well fluid can flow between an interior of the fluid chamber and an exterior of the fluid chamber, and in the closed position, the well fluid is blocked from flowing between the interior of the fluid chamber and the exterior of the fluid chamber; and a laser mounted adjacent to the fluid chamber and selectively directed towards the fluid chamber and operable to increase a temperature of the well fluid within the fluid chamber to generate a high heat well fluid when generating a heating laser beam; where in the open position the port is operable to the to allow the high heat well fluid to flow out of the fluid chamber to accelerate the tractor assembly within the wellbore.

15. The assembly of claim 14, further comprising centralizers extending from the fluid chamber, the centralizers sized to centralize the tractor assembly within the wellbore.

16. The assembly according to claim 14, further comprising an opening control system located at a surface location, the opening control system being in communication with the port and selectively signaling the port to move between the open position and the closed position.

17. The assembly according to claim 14, further comprising a sensor located at the fluid chamber and sensing properties of the well fluid within the fluid chamber, the sensor in communication with an opening control system located at a surface location.

18. The assembly according to claim 14, further comprising a receiver selectively receiving a resulting laser beam that results from a logging laser beam.

19. The assembly according to claim 18, further comprising a filter filtering the logging laser beam to form the resulting laser beam with a wavelength between 800 and 1000 nanometers.

20. The assembly according to claim 14, wherein the fluid chamber is formed of silicon carbide.

* * * * *